US011873538B2

(12) United States Patent
Müller et al.

(10) Patent No.: US 11,873,538 B2
(45) Date of Patent: Jan. 16, 2024

(54) COOLING DEVICE FOR SEAMLESS STEEL PIPES

(71) Applicant: SMS group GmbH, Düsseldorf (DE)

(72) Inventors: Torsten Müller, Mönchengaldbach (DE); Peter Thieven, Aachen (DE); Waldemar Vogel, Willich (DE); Stefan Ernst, Moers (DE)

(73) Assignee: SMS group GmbH, Düsseldorf (DE)

( * ) Notice: Subject to any disclaimer, the term of this patent is extended or adjusted under 35 U.S.C. 154(b) by 215 days.

(21) Appl. No.: 17/604,403

(22) PCT Filed: Apr. 14, 2020

(86) PCT No.: PCT/EP2020/060452
§ 371 (c)(1),
(2) Date: Nov. 8, 2021

(87) PCT Pub. No.: WO2020/212343
PCT Pub. Date: Oct. 22, 2020

(65) Prior Publication Data

US 2022/0213570 A1 Jul. 7, 2022

(30) Foreign Application Priority Data

Apr. 18, 2019 (DE) ..... 10 2019 205 724.1

(51) Int. Cl.
*C21D 9/08* (2006.01)
*C21D 8/10* (2006.01)
*C21D 1/667* (2006.01)

(52) U.S. Cl.
CPC ..... *C21D 9/085* (2013.01); *C21D 1/667* (2013.01); *C21D 8/105* (2013.01)

(58) Field of Classification Search
CPC ..... C21D 9/085; C21D 1/667; C21D 1/18; C21D 8/105
(Continued)

(56) References Cited

U.S. PATENT DOCUMENTS 3,208,742 A * 9/1965 Peretick ..... C21D 1/667 266/121
3,604,234 A * 9/1971 Hinrichsen ..... G05D 23/1919 72/12.2
(Continued)

FOREIGN PATENT DOCUMENTS

CN 102965480 A 3/2013
CN 103184386 A * 7/2013 ..... C22C 38/04
(Continued)

OTHER PUBLICATIONS

Wang Youming, "Controlled Rolling and Controlled Cooling of Steel", Beijing: Metallurgical Industry Press, (20090331) p. 203.

*Primary Examiner* — Scott R Kastler
*Assistant Examiner* — Michael Aboagye
(74) *Attorney, Agent, or Firm* — Smartpat PLC

(57) ABSTRACT

Cooling device (1) for cooling a seamless, rolled pipe (R) made of a metal, preferably steel, which has a nozzle assembly (10) comprising one or more nozzles (14), which are configured to apply a cooling medium (K), preferably water or a water mixture, to the outer circumferential surface of the pipe (R) while the pipe (R) is transported along a conveying direction (F) through a cooling section of the cooling device (1), wherein the nozzle assembly (10) has an access (Z), via which the pipe (R) can be removed from the cooling section in the radial direction of the pipe (R), preferably upward.

18 Claims, 2 Drawing Sheets

(58) Field of Classification Search
USPC ..... 266/114, 113, 115, 102, 46, 259
See application file for complete search history.

(56) References Cited

U.S. PATENT DOCUMENTS

| | | | | | |
|---|---|---|---|---|---|
| 3,889,507 | A | * | 6/1975 | Kranenberg | B21B 45/0224 72/201 |
| 3,932,238 | A | | 1/1976 | Safford | |
| 3,937,448 | A | | 2/1976 | Fujii et al. | |
| 4,075,041 | A | | 2/1978 | Ueno et al. | |
| 4,231,382 | A | | 11/1980 | Beerens | |
| 4,369,645 | A | * | 1/1983 | Brauer | C21D 9/5732 266/112 |
| 4,834,344 | A | | 5/1989 | Hoetzl et al. | |
| 5,788,784 | A | * | 8/1998 | Koppenhoefer | C21D 1/667 148/709 |
| 6,051,085 | A | * | 4/2000 | Tanaka | C21D 8/0215 148/541 |
| 2011/0272067 | A1 | | 11/2011 | Klarer | |
| 2017/0159142 | A1 | | 6/2017 | Wang et al. | |
| 2017/0283898 | A1 | | 10/2017 | Putta et al. | |
| 2017/0349965 | A1 | | 12/2017 | Fukuda et al. | |
| 2021/0087643 | A1 | | 3/2021 | Fukuda et al. | |

FOREIGN PATENT DOCUMENTS

| | | | | | |
|---|---|---|---|---|---|
| CN | 203715678 | U | | 7/2014 | |
| CN | 204097524 | U | | 1/2015 | |
| CN | 107058697 | A | | 8/2017 | |
| CN | 107109504 | A | | 8/2017 | |
| CN | 206916184 | U | | 1/2018 | |
| CN | 108315532 | A | | 7/2018 | |
| CN | 108315532 | A | * | 7/2018 | C21D 1/18 |
| CN | 111349759 | A | * | 6/2020 | C21D 1/18 |
| DE | 2649019 | A1 | | 12/1977 | |
| DE | 2727362 | A1 | | 12/1978 | |
| DE | 3123645 | A1 | | 12/1982 | |
| DE | 3809645 | A1 | | 9/1989 | |
| DE | 102014001146 | A1 | | 8/2015 | |
| DE | 102017001210 | A1 | | 8/2018 | |
| EP | 2682485 | A1 | | 1/2014 | |
| EP | 2837708 | A1 | * | 2/2015 | B21B 27/06 |
| EP | 3255160 | B1 | | 10/2019 | |
| FR | 2124278 | B1 | | 6/1976 | |
| JP | 2006152393 | A | | 6/2006 | |
| JP | 2013019023 | A | | 1/2013 | |
| JP | 6628008 | B2 | | 1/2020 | |
| WO | 2016035103 | A1 | | 3/2016 | |

* cited by examiner

COOLING DEVICE FOR SEAMLESS STEEL PIPES

TECHNICAL FIELD

The disclosure relates to a cooling device for cooling a seamless, rolled pipe, preferably steel pipe, with a nozzle assembly to apply a cooling medium to the outer circumferential surface of the pipe.

BACKGROUND

In the production of seamless steel pipes, a stretch-reducing rolling mill or sizing mill is used, which has several roll stands arranged one behind the other in the conveying direction of the pipe. The parent pipes coming from an upstream unit are inserted into the sizing or stretch-reducing rolling mill in the hot-rolled condition. The operating temperatures for steel pipes are mostly in the range between 900° C. and 1,000° C. If the temperature of the pipe after the roughing unit is too low for rolling, it is reheated in an intermediate furnace.

When leaving the rolling mill, the material temperature is still above the austenitizing point (Ar3 transformation point), approximately above 820 to 840° C. depending on the material grade. As a rule, the pipes are cooled in the air by natural convection. This produces a normal-rolled microstructure; that is, the pipe is moderately fine-grained, mostly free of deformation textures that negatively affect the mechanical properties.

Improved mechanical properties, in particular higher strength combined with high toughness and weldability, are in demand for higher-grade pipes, for example for oil and gas production or structural pipes. To improve the mechanical properties, quenching and tempering the rolled and cooled pipes in special heat treatment lines is known. In this process, the pipes are reheated to the austenitizing temperature in a first tempering step, then rapidly cooled in quenching equipment, forming high-strength transformation phases such as martensite, and finally reheated to remove internal residual stresses.

This additional heat treatment is process-intensive and energy-intensive. For this reason, processes that use the residual heat of the rolling process for heat treatment have been developed. For this purpose, the pipe is cooled very quickly after the sizing or stretch-reducing rolling, wherein cooling rates that are significantly increased compared to the normal cooling bed must be achieved. The required cooling rates are achieved by special cooling sections that are not part of the common equipment of seamless pipe mills. They cool the pipe at an accelerated rate immediately after it leaves the rolling mill by external application of a cooling medium, such as water or a water/air mixture.

For example, EP 2 682 485 B1 describes a method and a device for the production of seamless steel pipes with a continuous cooling section downstream of the last rolling stand, which has a plurality of distribution rings arranged concentrically around the rolled material. The distribution rings have three or more nozzles for spraying the cooling medium onto the pipe to be cooled.

In accordance with this prior art, the distribution rings surround the pipe to be cooled concentrically to its central axis. A large number of such distribution rings must be provided to cool the pipe sufficiently quickly during transport from the rolling mill. A disadvantage is that, in the event of a malfunction, where the pipe remains on the outlet side of the rolling mill, it is not readily possible to lift the pipe out of the transport section, as it is enclosed by the distribution rings. Rather, the pipe must be cut into small pieces, which must then be manually removed from the cooling section.

In accordance with another technical solution known from WO 2016/035103 A1, the pipe to be cooled is lifted into a cooling device from below. In doing so, the pipe must be rotated around its own axis during cooling in order to achieve uniform cooling. However, in the case of a continuous cooling section immediately downstream of a rolling mill, it is not possible to set the pipe in rotation, since at the beginning of the run-out process, that is at the start of cooling, it is still engaged in the rolling mill with its rear end. In addition, the pipe lengths downstream of the rolling mill are usually significantly longer than in the heat treatment lines, since, in the latter, the pipes are already cut to finished lengths of 8 to 14 m, for example, while the pipe conduits at the rolling mill exit are still undivided and up to 100 m long. Such long cooling sections are technically complex and hardly economical to operate.

SUMMARY

One object of the disclosure is to improve the through-flow cooling of seamless, rolled pipes made of metal, preferably steel, and in particular their operational reliability.

The object is achieved with a cooling device as claimed. Advantageous further embodiments follow from the dependent claims, the following illustration of the invention and the description of preferred exemplary embodiments.

The cooling device is used for cooling a seamless, rolled pipe. The pipe is a metal pipe, preferably steel pipe. However, all alloys whose mechanical properties, such as strength, tensile strength, toughness, weldability, etc., can be improved by means of heat treatment are included. In particular, the pipe is made of a high-quality alloy suitable for use in oil and gas production or construction pipe.

The cooling device has a nozzle assembly with one or more nozzles, which are configured to apply a cooling medium to the outer circumferential surface of the pipe, preferably water or a water mixture, while the pipe is transported along a conveying direction through a cooling section of the cooling device. The term "water mixture" refers to a water-based cooling medium containing one or more additives. The additives can include dissolved solids, liquids or even gases. For example, the cooling medium may be a water/air mixture. The term "cooling section" is used herein to refer to that section of the cooling device along the conveying direction in which the pipe is exposed to the cooling medium. The cooling device provides continuous cooling, since the pipe is cooled during a conveyance or transport, as the case may be, through the cooling section.

The nozzle assembly has an access via which the pipe can be removed from the cooling section in the radial direction of the pipe, that is perpendicular to the longitudinal extension of the pipe. In other words, the nozzle assembly does not completely surround the pipe in the circumferential direction, but is open or openable on one side. The access is dimensioned so that the pipe can be removed laterally or radially from the cooling section. Preferably, the access is placed in such a way that the pipe can be taken out upward (seen in the direction of gravity). Further, the access preferably extends in a straight line parallel to the pipe axis, in order to facilitate any removal of the pipe from the cooling section. It should be noted that a plurality of accesses may also be provided.

Accordingly, the nozzle assembly does not include closed-ring-type structures. Rather, at least one access is provided, which allows the pipe to be removed from the cooling section in the radial direction in the event of a malfunction, such as an accident. The working space in the region of the access is not obstructed by lines, pipes or the like. This creates a cooling section that, on the one hand, can be short enough to process still undivided pipe conduits of, for example, up to 100 m in length, and from which, on the other hand, the pipes can be removed laterally without first having to cut them into smaller pipe sections in the cooling device. In addition, the access facilitates any maintenance and cleaning work on the cooling device.

The cooling device is particularly preferably configured for the rapid cooling of the pipe immediately downstream of a rolling mill, such as a stretch-reducing rolling mill or a sizing mill. The term "immediately downstream" is to be understood here as meaning that the pipe enters the cooling section of the cooling device while it is still engaged in the rear end of the rolling mill. It should be noted that the designations "upstream" and "downstream" are to be seen relative to the conveying direction of the pipe.

In order to ensure uniform cooling along the circumference of the pipe despite the absence of concentric distribution rings, the nozzles can be configured, arranged and aligned in such a manner that the amount of cooling medium sprayed on is essentially constant along the circumference of the pipe. In other words, the flow rate of the cooling medium per nozzle and the direction of radiation can be adjusted to achieve, or at least approximate, symmetrical and concentric cooling.

Preferably, for this purpose, the nozzle assembly has one or more nozzle arms, each having at least one distribution pipe and one or more nozzle lances connected thereto and extending therefrom, each having one or more nozzles. By providing nozzle arms, the supply of cooling medium to the nozzles can be ensured in a structurally simple manner, without the supply lines having to completely surround the pipe in the circumferential direction. The nozzle lances may have different lengths in order to spray the cooling medium evenly over as much of the pipe circumference as possible. In the case of rectilinear distribution pipes, the nozzle lances may be longer at the edge sections than in the center of the corresponding distribution pipe, as a result of which the nozzles are located at least approximately on an imaginary partial ring.

Preferably, the cooling device further comprises a fluid system, which is configured to supply the distribution pipes with the cooling medium, wherein, in this case, a plurality of distribution pipes may be combined to form in each case a fluid unit that is served by a common pump and/or switched by a common valve system. By combining the fluid supply in such a modular manner, it can be simplified structurally, and at the same time the nozzles can be operated section-by-section at different pressures, volume flow rates, etc., which allows the cooling of the pipe to be optimized.

Preferably, the distribution pipes are configured to convey the cooling medium in the cross-sectional plane of the pipe and/or along the conveying direction, by which an access can be created in a structurally simple manner, which access extends rectilinearly parallel to the pipe axis.

Preferably, the cooling section is shorter than the pipe; for example, it amounts to approximately 8 to 16 m. In this way, a compact cooling device is created, by which the tempering of the pipes by means of heat treatment can be realized with a justifiable structural effort.

Preferably, the position and/or orientation and/or volume flow rate of one or more nozzles of the nozzle assembly is adjustable, allowing the cooling effect to be flexibly adapted, for example depending on product and/or process parameters.

Preferably, the nozzles of the nozzle assembly are configured in such a way that several spray planes are formed, which can be adjustable or displaceable, as the case may be, along the conveying direction, for example. For example, each spray plane can have two nozzle arms, each with multiple nozzle lances. By suitable placement of the spray planes, the cooling effect can be flexibly adjusted, for example depending on product and/or process parameters.

Preferably, the cooling device is configured to cool the pipe to a final temperature below the Ar3 transformation point, in order to thereby form high-strength transformation phases such as martensite. Preferably, the pipe is cooled to approximately 450° C. to 600° C. for this purpose. The initial temperature, that is, the temperature at which the pipe leaves the rolling mill, amounts to 820° C. to 840° C., for example.

Preferably, the cooling device is configured to perform a section-by-section or quasi-continuous control of pressure and/or flow rates of the cooling medium, preferably as a function of the product and/or based on measured values, empirical values and/or a process model. Controllability here relates to sections along the cooling section, which means that the heat transfer coefficients can be flexibly adjusted in the conveying direction. The controllable sections may each include one or more spray planes, nozzle arms, etc.; however, they may also be refined down to the structural level of individual nozzles. This is what is meant by the term "quasi-continuous."

Preferably, the cooling section is subdivided in such a way that, in a first section, the nozzle assembly is configured for high-pressure spraying, preferably with pressures of more than 10 bar, and in a subsequent section in the conveying direction for lower pressures. In the high-pressure range, for example, heat transfer coefficients of more than 10,000 $W/(m^2K)$ are achievable, by which an abrupt cooling of the pipe is achievable.

Preferably, the cooling device is configured for discontinuous operation in such a way that one or more nozzles can be switched on correspondingly with the entry of the pipe into the cooling section, that is, with the passage of the front pipe end, and can be switched off with the exit of the pipe from the cooling section, that is, with the passage of the rear pipe end, wherein preferably one or more sensors, which are configured for detecting the pipe ends, are arranged inside or downstream of the cooling section. This prevents cooling medium from entering the pipe.

Preferably, the cooling device further comprises an enclosure, which completely or partially surrounds the nozzle assembly and/or one or more compressed air wipers. Contamination of the environment with cooling medium is avoided by an enclosure; in particular, spray water and water vapor contamination of the environment can be reduced. For a similar purpose, compressed air wipers can be used to prevent the cooling medium from entering particularly vulnerable equipment, such as radiometric wall thickness or other measuring points upstream and/or downstream of the cooling section.

Preferably, the conveying direction of the pipe along the cooling section is inclined relative to the horizontal; that is, it falls or rises, which allows the installation space to be shortened during the transition from the rolling mill to any cooling bed.

The object set forth above is further solved by a device comprising a rolling mill, preferably a stretch-reducing mill or a sizing mill, and a cooling device as described above. The cooling device is located downstream of the rolling mill and is configured to cool the pipe rolled through the rolling mill.

The features, technical effects, advantages along with exemplary embodiments described with respect to the cooling device apply analogously to this device.

In particular, the cooling device is arranged immediately downstream of the rolling mill, by which the residual heat of the rolling process is shared in a synergetic manner for the tempering of the pipe by means of heat treatment.

Preferably, the rolling mill has one or more cooling elements, which are configured to reduce the temperature of the pipe in the rolling mill below the Ar3 transformation point, preferably by approximately 30° below the Ar3 transformation point. In this way, the cooling effect can be strengthened. In accordance with this exemplary embodiment, the feed or rolling temperature is thus already lowered in the rolling mill, such that a lower final rolling temperature than is normally the case is applied.

Further advantages and features of the present invention are apparent from the following description of preferred exemplary embodiments. The features described therein may be implemented alone or in combination with one or more of the features set forth above, provided that the features do not contradict each other. The following description of preferred exemplary embodiments is made with reference to the accompanying drawings.

DETAILED DESCRIPTION

Preferred exemplary embodiments are described below with reference to the figures. Thereby, identical, similar or similarly acting elements are provided with identical reference signs in the various figures, and a repeated description of such elements is sometimes omitted in order to avoid redundancies.

Figure 1:
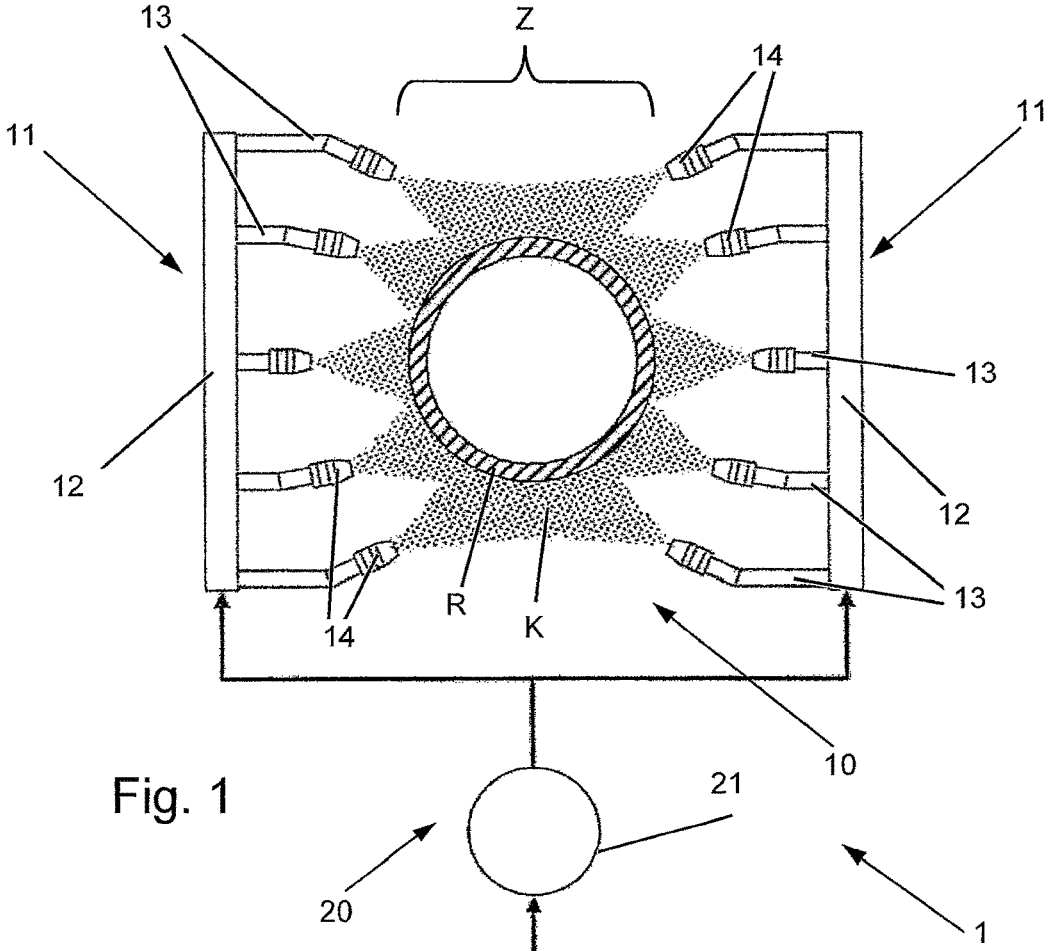
FIG. 1 is a schematic cross-sectional view of the nozzle assembly of a continuous cooling section with an attached fluid unit in accordance with one embodiment.
Figure 2:
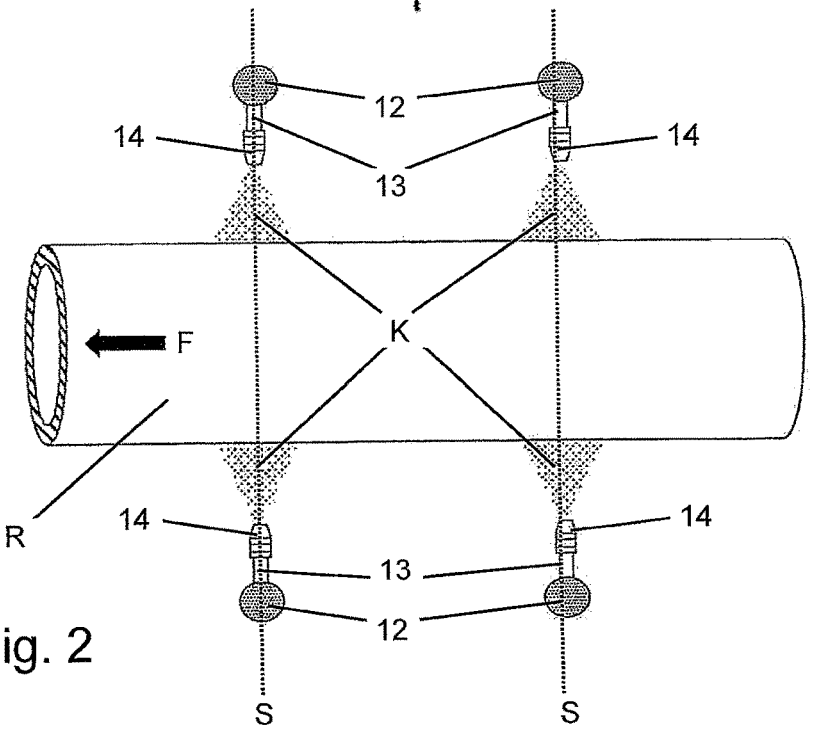
FIG. 2 shows the nozzle assembly of FIG. 1 in a top view.

FIG. 1 is a schematic cross-sectional view of the nozzle assembly 10 of a continuous cooling section with an attached fluid unit 20 in accordance with one embodiment. FIG. 2 shows the nozzle assembly 10 in a top view.

The nozzle assembly 10 is part of a cooling device 1, which is arranged as a continuous cooling section preferably directly downstream of a rolling mill for rolling seamless pipes R. In this context, the term "directly" means that the pipe R enters the continuous cooling section while it is still engaged in the rear end of the rolling mill, as seen in the conveying direction F (see FIG. 2).

The pipe R is made of a metal, preferably steel, comprising in particular high-quality alloys suitable for use in oil and gas production or for structural pipes.

The rolling mill set forth above, not shown in the figures, is preferably a stretch-reducing rolling mill or a sizing mill, which has a plurality of roll stands arranged one behind the other in the conveying direction F of the pipe R. The parent pipes coming from an upstream unit are inserted into the rolling mill in the hot-rolled condition. The operating temperatures are in the range between 900° C. and 1,000° C., for example. Upon leaving the rolling mill, the pipe R preferably has a temperature of over 820° C. to 840° C.

The nozzle assembly 10 has one or more nozzle arms 11, each having at least one distribution pipe 12 and one or more nozzle lances 13 attached thereto and extending therefrom, each having one or more nozzles 14. The distribution pipes 12 are supplied with a cooling medium K, preferably water or a water mixture, via a fluid system, which then flows to the nozzles 14 via the nozzle lances 13 and is discharged or sprayed, as the case may be, by them onto the pipe R.

The nozzle arms 11 with their distribution pipes 12 and nozzle lances 13 may be arranged in planes referred to herein as "spray planes" S. In the present exemplary embodiment, each spray plane S has, by way of example, two nozzle arms 11, each with a distribution pipe 12 and five nozzle lances 13 connected thereto. However, there is no restriction in this respect. Rather, the number and arrangement of the nozzle arms 11, nozzle lances 13 along with nozzles 14 can be freely selected as long as the uniform cooling of the pipe R is ensured and the nozzle assembly 10 does not comprise any closed-ring-type structures, as explained further below.

In FIG. 2, only two spray planes S are shown. Both spray planes S include a plurality of nozzles. The spray planes S are shown parallel to one another and perpendicular to the conveying direction (F). However, the number of spray planes S arranged along the conveying path of the pipe S is usually larger, in order to provide a sufficient cooling effect. The cooling section, that is, that section of the conveying path in which the cooling medium K is applied to the pipe R, can be comparatively short, for example 8 to 16 m, depending on the number, position and orientation of the nozzles 14, the throughput of the cooling medium K, etc.

The nozzle assembly 10 can be configured such that the spray planes S or a part thereof are adjustable along the conveying direction F. For this purpose, the nozzle arms 11 or a part of them may be displaceably mounted. Alternatively or additionally, the nozzle lances 13 or a part thereof can be arranged to swivel, for example by the corresponding nozzle arms 11 being mounted to rotate about their own axes. Further, it is not essential that the nozzle assembly 10 form a plurality of well-defined spray planes. The nozzle lances 13 with their nozzles 14 can, for example, be positioned and/or aligned in such a way that the pipe R, viewed in the conveying direction F, is essentially uniformly applied with the cooling medium K.

A plurality of distribution pipes 12 may be combined into one fluid unit 20 each, which is served by a common pump 21 and/or switched by a common valve system.

Figure 3:
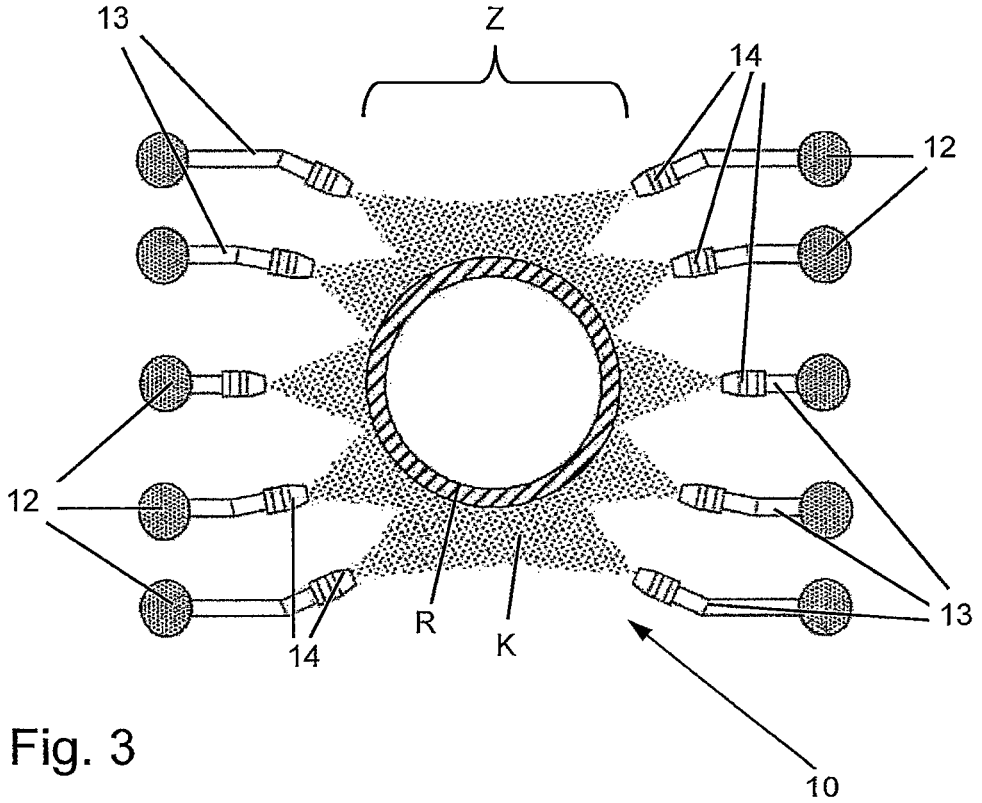
FIG. 3 is a schematic cross-sectional view of the nozzle assembly of a continuous cooling section in accordance with a further embodiment.
Figure 4:
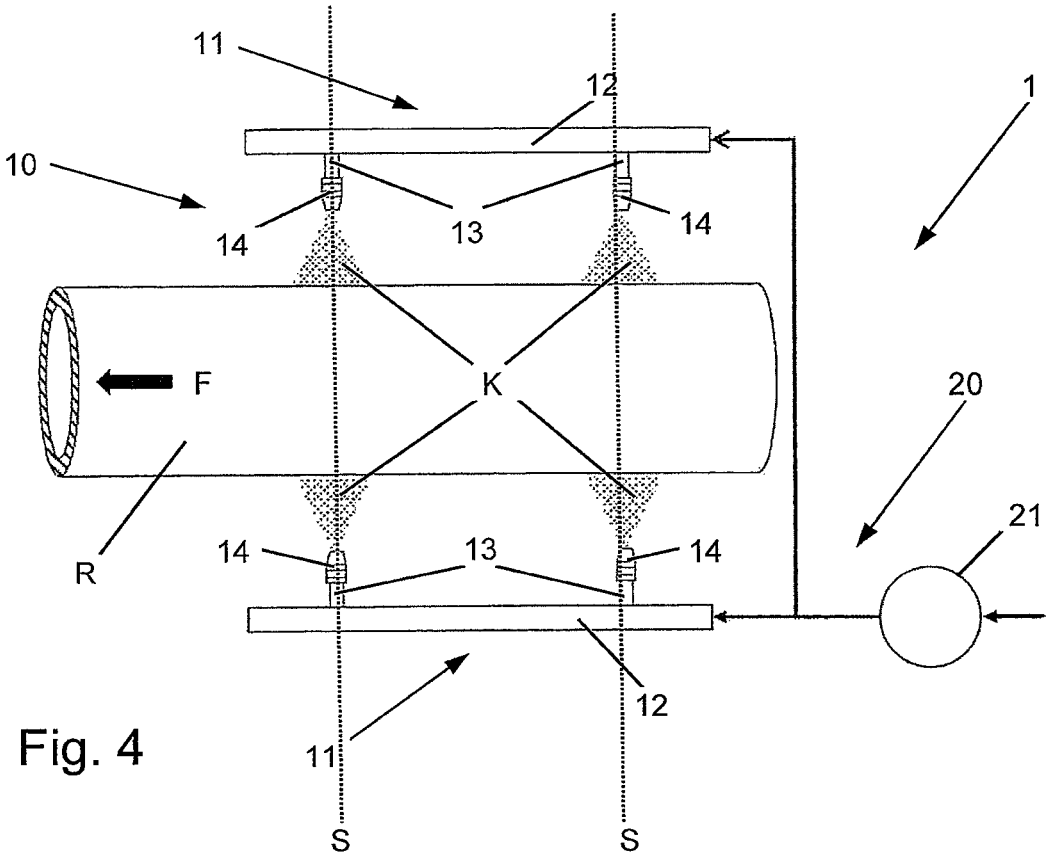
FIG. 4 shows a top view of the nozzle assembly in accordance with FIG. 3 with an attached fluid unit.

In accordance with the exemplary embodiment of FIGS. 1 and 2, the distribution pipes 12 convey the cooling medium K in the cross-sectional plane of the pipe R. Alternatively, the cooling medium K can also be conveyed along the longitudinal axis of the pipe (=conveying direction F), as shown in the exemplary embodiment of FIGS. 3 and 4. Of course, the distribution pipes 12 may be arranged in other ways, as long as the access Z outlined below is provided.

It has already been pointed out that the nozzle assembly 10 does not comprise closed-ring-type structures. Rather, the nozzle arms 11 are designed to be open at least on one side, so that the pipe R may be removed from the cooling section in the radial direction, preferably upward, in the event of a malfunction (accident). In other words, the nozzle assembly 10 leaves an unobstructed gap or access Z along the conveying direction F through which the pipe R can be removed, if necessary. The working space in the region of the access Z is not obstructed by lines, pipes or the like. The dimension of the access Z is larger than the diameter of the pipe R, in order to ensure the unobstructed removal of the pipe R from the cooling section.

Thus, a cooling section is created which, on the one hand, is short enough to be able to process still undivided pipe conduits of, for example, up to 100 m in length, and from which, on the other hand, the pipes R can be easily removed, for example in the event of a malfunction, in particular without having to cut them first at the spray planes S.

In order to ensure uniform cooling along the circumference of the pipe despite the absence of concentric distribution rings, the nozzles 14 can be configured, arranged and aligned in such a way that the quantity of cooling medium K sprayed on is essentially constant along the circumference of the pipe. In other words, the flow rate of cooling medium K per nozzle 14 and the direction of radiation can be adjusted to achieve, or at least approximate, symmetrical and concentric cooling. In the case of rectilinear distribution pipes 12, as shown in FIG. 1, the nozzle lances 13 can be longer at the edge sections than in the center of the corresponding distribution pipe 12 for this purpose, by which the nozzles 14 are located at least approximately on an imaginary partial ring.

The cooling device 1 presented herein is suitable for cooling the pipes R to final temperatures of approximately 450° C. to 600° C., by which a particularly fine-grained microstructure can be obtained. Following cooling by the cooling device 1, the pipe R can be further cooled to room temperature by air convection.

In conjunction with an upstream rolling train, the parent pipe is preferably first cooled to temperatures below the Ar1 transformation point and then reheated to rolling temperature. The pipe R is then rolled in the rolling mill and transferred or transported to the cooling device 1 for subsequent rapid cooling.

In accordance with an advantageous embodiment example, the cooling section is divided into several sections, wherein, in a first section, the nozzle assembly 10 is configured for high-pressure spraying, for example with pressures of more than 10 bar, and in a subsequent section in the conveying direction F for lower pressures. In the high-pressure range, for example, heat transfer coefficients of more than 10,000 W/($m^2$K) are achievable.

Alternatively or additionally, a section-by-section or quasi-continuous control of pressure and/or flow rates of the cooling medium K, viewed in the conveying direction F, can be implemented as a function of the product and/or based on measured values, empirical values and/or a process model.

The cooling device 1 can be configured for discontinuous operation in that nozzle arms 11 can be switched on, for example, in accordance with the passage of the front end of the pipe and switched off with the passage of the rear end of the pipe, thereby preventing cooling medium K from entering the pipe R. For this purpose, one or more sensors configured to detect the pipe ends can be located inside or downstream of the cooling section.

Preferably, the cooling section is located completely or section-by-section in an enclosure, in order to avoid the contamination of the environment with cooling medium K, in particular to reduce spray water and water vapor contamination of the environment. For a similar purpose, compressed air wipers can be used to prevent the cooling medium K from entering particularly vulnerable equipment, such as radiometric wall thickness or other measuring points upstream and/or downstream of the cooling section.

The conveying direction F of the pipe R along the cooling section can be inclined (rising or falling), which can shorten the installation space during the transition from the rolling mill to any cooling bed. Additionally or alternatively, the cooling section can be integrated into the transition region to the cooling bed. Since the spray chamber is not closed due to the access Z, the pipe R can be lifted out of the cooling section and transferred to the cooling bed.

The cooling device 1 presented herein is also suitable for combination with auxiliary cooling elements in the rolling mill, in order to enhance the cooling effect. In accordance with one exemplary embodiment, a lowering of the feed or rolling temperature takes place in the rolling mill, such that a lower final rolling temperature than is normally the case is applied. In the rolling mill, for example, the pipe R can be sub-cooled to a temperature of approximately 30° C. below the Ar3 transformation point.

To the extent applicable, any of the individual features set forth in the exemplary embodiments may be combined and/or interchanged without departing from the scope of the invention.

LIST OF REFERENCE SIGNS

1 Cooling device
10 Nozzle assembly
11 Nozzle arm
12 Distribution pipe
13 Nozzle lance
14 Nozzle
20 Fluid unit
21 Pump
R Pipe
F Conveying direction
K Cooling medium
S Spray plane
Z Access

The invention claimed is:

1. A cooling device (1) for cooling a seamless, rolled metal pipe (R), comprising:

a nozzle assembly (10) comprising one or more nozzles (14), which are configured to apply a cooling medium (K) to an outer circumferential surface of the pipe (R) while the pipe (R) is transported along a conveying direction (F) through a cooling section of the cooling device (1), wherein the cooling device (1) is arranged immediately downstream of a rolling mill for rolling the pipe (R), such that the pipe (R) enters the cooling section while it is still engaged in the rolling mill with its rear end, and wherein the nozzle assembly (10) has an access (Z) formed by a gap that is larger than a diameter of the pipe (R) and unobstructed along the conveying direction (F), and wherein the pipe (R) can be removed from the cooling section in a radial direction of the pipe (R) and perpendicular to a longitudinal extension of the pipe (R) through the access (Z) after the rear end of the pipe (R) has exited the rolling mill.

2. The cooling device (1) according to claim 1,
wherein the cooling medium (K) is water or a water mixture and
wherein the radial direction is upward.

3. The cooling device (1) according to claim 1,
wherein the nozzle assembly (10) comprises one or more nozzle arms (11), each comprising
at least one distribution pipe (12) and
one or more nozzle lances (13) attached to and extending from the at least one distribution pipe (12), and
wherein each nozzle lance comprises one or more of the one or more nozzles (14).

4. The cooling device (1) according to claim 3,
wherein the at least one distribution pipe (12) comprises a plurality of distribution pipes (12),
wherein the cooling device (1) further comprises a fluid system, which is configured to supply the distribution pipes (12) with the cooling medium (K), and
wherein the distribution pipes (12) are combined to form a fluid unit (20) that is served by a common pump (21) and/or switched by a common valve system.

5. The cooling device (1) according to claim 3,
characterized in that the at least one distribution pipe (12) is configured to convey the cooling medium (K) in a cross-sectional plane of the pipe (R) and/or along the conveying direction (F).

6. The cooling device (1) according to claim 1,
wherein the cooling section is 8 to 16 m long.

7. The cooling device (1) according to claim 1,
wherein a position and/or orientation and/or volume flow rate of one or more nozzles (14) of the nozzle assembly (10) is adjustable.

8. The cooling device (1) according to claim 1,
wherein the one or more nozzles (14) comprise
a first plurality of nozzles arranged in a first spray plane (S) perpendicular to the conveying direction (F) and
a second plurality of nozzles arranged in a second spray plane (S) perpendicular to the conveying direction (F), and
wherein the first spray plane (S) and the second spray plane (S) are adjustable along the conveying direction (F).

9. The cooling device (1) according to claim 1,
wherein the cooling device (1) is configured to cool the pipe (R) to a final temperature of 450° C. to 600° C.

10. The cooling device (1) according to claim 1,
wherein the cooling device (1) is configured to individually control pressure and/or flow rates of the cooling medium (K) in each of the nozzles (14).

11. The cooling device (1) according to claim 1,
wherein the cooling section is subdivided into a plurality of sections,
wherein, in a first section, the nozzle assembly (10) is configured for high-pressure spraying with pressures of more than 10 bar and in a subsequent section in the conveying direction (F) for lower pressures.

12. The cooling device (1) according to claim 1,
wherein the cooling device (1) is configured for discontinuous operation in such a way that one or more of the nozzles (14) is/are switched on upon entry of the pipe (R) into the cooling section and is switched off upon exit of the pipe (R) from the cooling section, and
wherein one or more sensors, which are configured for detecting pipe ends, are arranged inside or downstream of the cooling section.

13. The cooling device (1) according to claim 1, further comprising
an enclosure which completely or partially surrounds the nozzle assembly (10) and/or
one or more compressed air wipers.

14. The cooling device (1) according to claim 1,
wherein the conveying direction (F) of the pipe (R) along the cooling section is inclined relative to the horizontal.

15. A device, comprising:
a rolling mill; and
the cooling device according to claim 1,
wherein the cooling device is located downstream of the rolling mill in the conveying direction (F) and configured for cooling the pipe (R) rolled by the rolling mill.

16. The device according to claim 15,
wherein a temperature of the pipe (R) exiting the rolling mill is below the Ar3 transformation point.

17. The cooling device (1) according to claim 1,
wherein the nozzle assembly (10) comprises two nozzle arms (11) arranged on opposite sides of the pipe (R), each comprising
a distribution pipe (12) having a center portion that is closer to the pipe (R) than end portions thereof, and
a plurality nozzle lances (13) attached to and extending from the distribution pipe (12), each nozzle lance comprises one of the nozzles (14), and
wherein nozzle lances (13) of the plurality nozzle lances (13) extending from the center portion are shorter than the nozzle lances (13) of the plurality nozzle lances (13) extending from the end portions.

18. The cooling device (1) according to claim 1,
wherein the nozzles are arranged symmetrical relative to a horizontal plane through the center axis of the pipe (R).

* * * * *